US005659907A

United States Patent [19]

Huang

[11] Patent Number: 5,659,907

[45] Date of Patent: Aug. 26, 1997

[54] FOLDABLE HAMMOCK ASSEMBLY

[76] Inventor: Ton-Chau Huang, No. 21, Lane 511, Her Guang Load, Homei Town, Chang Hua County, Taiwan

[21] Appl. No.: 380,631

[22] Filed: Jan. 30, 1995

[51] Int. Cl.[6] ..... A45F 3/24

[52] U.S. Cl. ..... 5/128; 5/127; 5/120

[58] Field of Search ..... 5/127–129, 120; 248/166, 434, 201, 133

[56] References Cited

U.S. PATENT DOCUMENTS

| | | | |
|---|---|---|---|
| 300,304 | 6/1884 | Butterworth | 5/127 |
| 320,174 | 6/1885 | Rudd et al. | 5/129 |
| 381,025 | 4/1888 | Parmelee | 5/129 |
| 711,579 | 10/1902 | Morehouse | 5/129 |
| 1,320,381 | 11/1919 | Dittrick | 5/129 |
| 2,071,016 | 2/1937 | Archer | 5/129 |
| 4,691,394 | 9/1987 | Woo | 5/129 |
| 5,003,652 | 4/1991 | Bayless | 5/129 |
| 5,113,538 | 5/1992 | Branch, III | 5/127 |

FOREIGN PATENT DOCUMENTS

| | | | |
|---|---|---|---|
| 705671 | 3/1931 | France | 5/129 |

*Primary Examiner*—Steven N. Meyers
*Assistant Examiner*—TuYet-Phoung Pham
*Attorney, Agent, or Firm*—Beveridge, DeGrandi, Weilacher & Young LLP

[57] ABSTRACT

A hammock includes a frame for supporting a support sheet material. The frame includes two beams having end portions secured together and each having a free end. A pair of posts include lower portions secured on the free ends of the beams. The posts are arranged slightly inclined relative to the beams and include two hooks secured to the upper ends for supporting the support sheet material. The support sheet material may be stably supported in place by the frame without securing to trees. The frame may be folded to a compact configuration.

12 Claims, 4 Drawing Sheets

FOLDABLE HAMMOCK ASSEMBLY

BACKGROUND OF THE INVENTION

1. Field of the Invention

The present invention relates to a hammock, and more particularly to a foldable hammock assembly.

2. Description of the Prior Art

Typical hammocks comprise a sheet of woven materials including two ends secured to trees or posts. In order to support the hammocks, fastening means should be secured to the trees for supporting the hammocks. However, the fastening means may damage the trees.

The present invention has arisen to mitigate and/or obviate the afore-described disadvantages of the conventional hammocks.

SUMMARY OF THE INVENTION

The primary objective of the present invention is to provide a foldable hammock assembly which includes a frame member for supporting the support sheet material.

The other objective of the present invention is to provide a foldable hammock assembly in which the frame member may be folded to a compact configuration for storing and transportation purposes.

In accordance with one aspect of the invention, there is provided a hammock assembly comprising a frame means for supporting a support sheet material. The frame means comprises a base means including two beams having first ends secured together and each having a second end, the second ends each including a fastening member provided thereon, a pair of posts including lower portions engaged on the end portions of the base means and having key holes for engaging with the fastening members, the posts being arranged substantially in perpendicular to the base means, the posts including an upper portion, a pair of link means for securing the lower portions of the posts to the base means, and hook means secured to the upper portions of the posts for supporting sheet material.

The beams each includes a middle portion having a bolt extended downward therefrom and having a notch portion formed therein, and a pair of bars engaged in the notch portion and engaged with the bolts so as to be maintained in a position in perpendicular to the beams.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
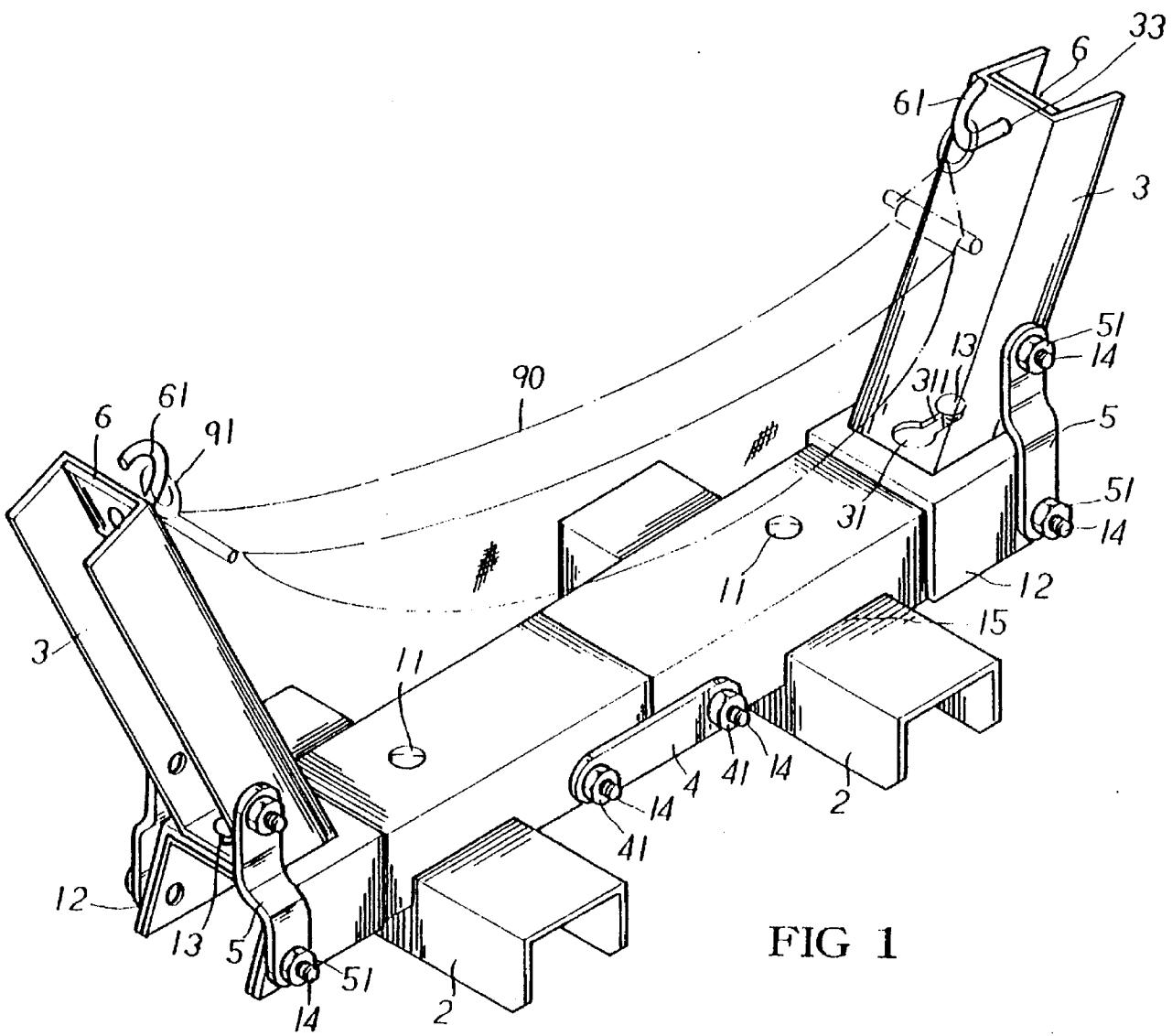
FIG. 1 is a perspective view of a foldable hammock assembly in accordance with the present invention.
Figure 2:
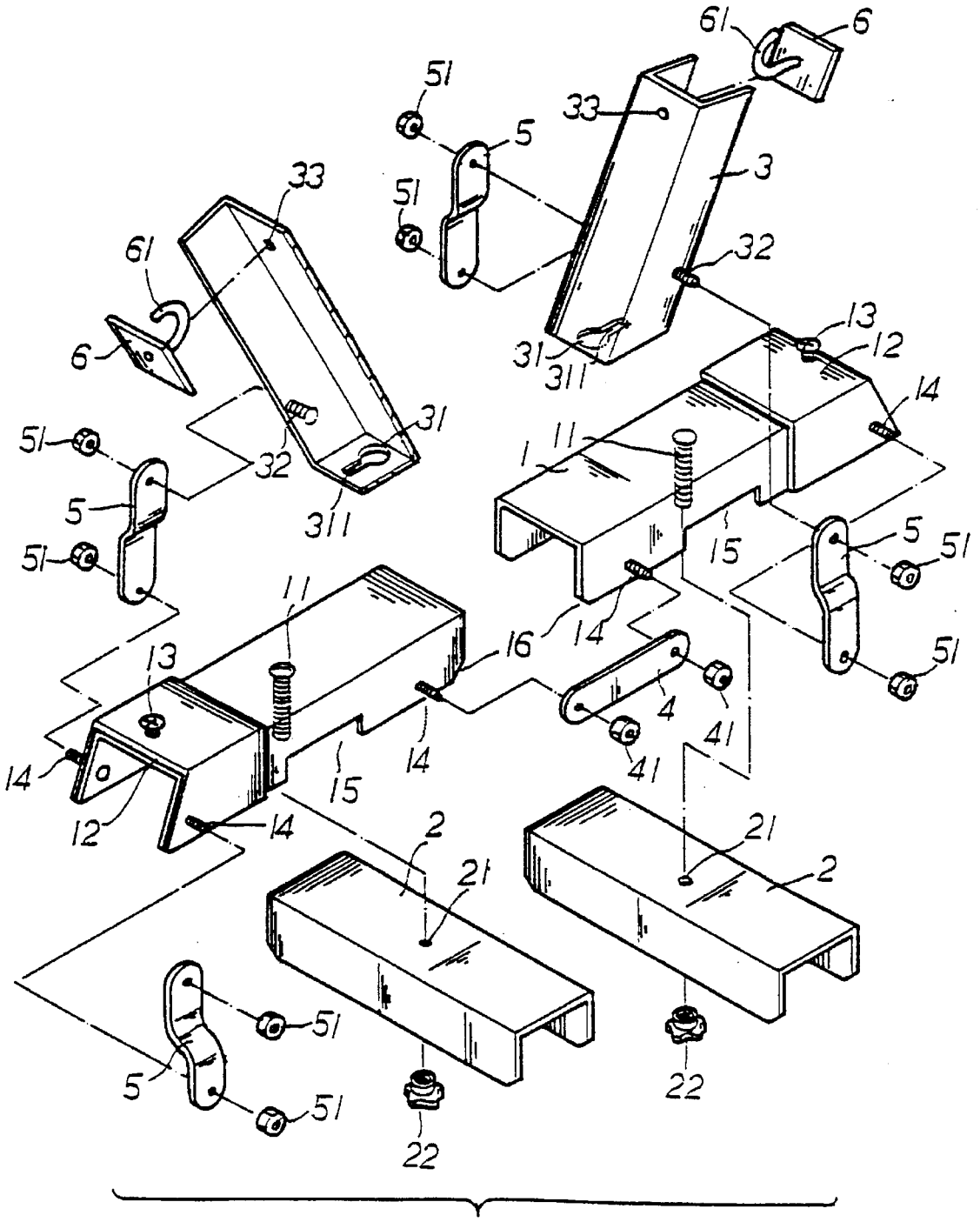
FIG. 2 is an exploded view of the foldable hammock assembly.

Referring to the drawings, and initially to FIGS. 1 and 2, a foldable hammock assembly in accordance with the present invention comprises a frame member including a base having a pair of base portions portions or beams 1 secured together by a pair of strips 4 which are secured to the beams 1 by bolts 14 and nuts 41. The beams 1 may be folded to a parallel position as shown in FIG. 4 to define a chamber 4 when the strips 4 are released. The beams 1 each includes a bolt 11 extended downward from the middle portion thereof for engaging with holes 21 of a pair of support 2 and for engaging with nuts 22 which secure the bars 2 to the beams 1. The beams 1 each includes a notch portion 15 formed in the middle of the bottom portion for engaging with the bars 2 such that the bars 2 may be maintained in a position in perpendicular to the beams 1. The bars 2 may be engaged within the beams 1 when the nuts 22 are sufficiently loosened and when the bars 2 are disengaged from the notch portions 15, best shown in FIGS. 3 and 4. The beams 1 each includes a free end portion having a reinforcing member 12 secured thereon, having a pair of bolts 14 oppositely secured thereto, and having a screw 13 provided on the upper portion.

A pair of posts 3 each includes a lower end for engaging with the free ends of the beams 1 and each includes a key hole 31 formed in the bottom for engaging with the screws 13. The key holes 31 each includes a narrower end 311 for engaging with the screws 13 which may solidly secure the posts 3 to the beams. The posts 3 are preferably arranged in a position slightly inclined relative to the beams 1, best shown in FIG. 1. The lower ends of the posts 3 each includes a pair of bolts 32 laterally extended outward for engaging with a pair of links 5 which are also engaged with the bolts 14 of the beams 1. Nuts 51 are engaged with the bolts 14, 32 so as to further secure the posts 3 to the beams 1. The upper ends of the posts 3 each includes an orifice 33 formed therein for engaging with a hook 61 which is secured to a board 6. The hooks 61 are threaded through the orifices 33 for engaging with ring elements 91 which are secured in the end portions of the support sheet material 90. The boards 6 may engage with the posts 3 so as to maintain the hooks 61 in place. The support sheet material 90 may be stably supported between the posts 3 without securing to trees or other post members. Each of the base portions, supports, and posts are formed with a channel running the length of each member. Each base portion channel has a width greater the width of the support channels. The width of each post channel is less than the width of the support channels.

Figure 3:
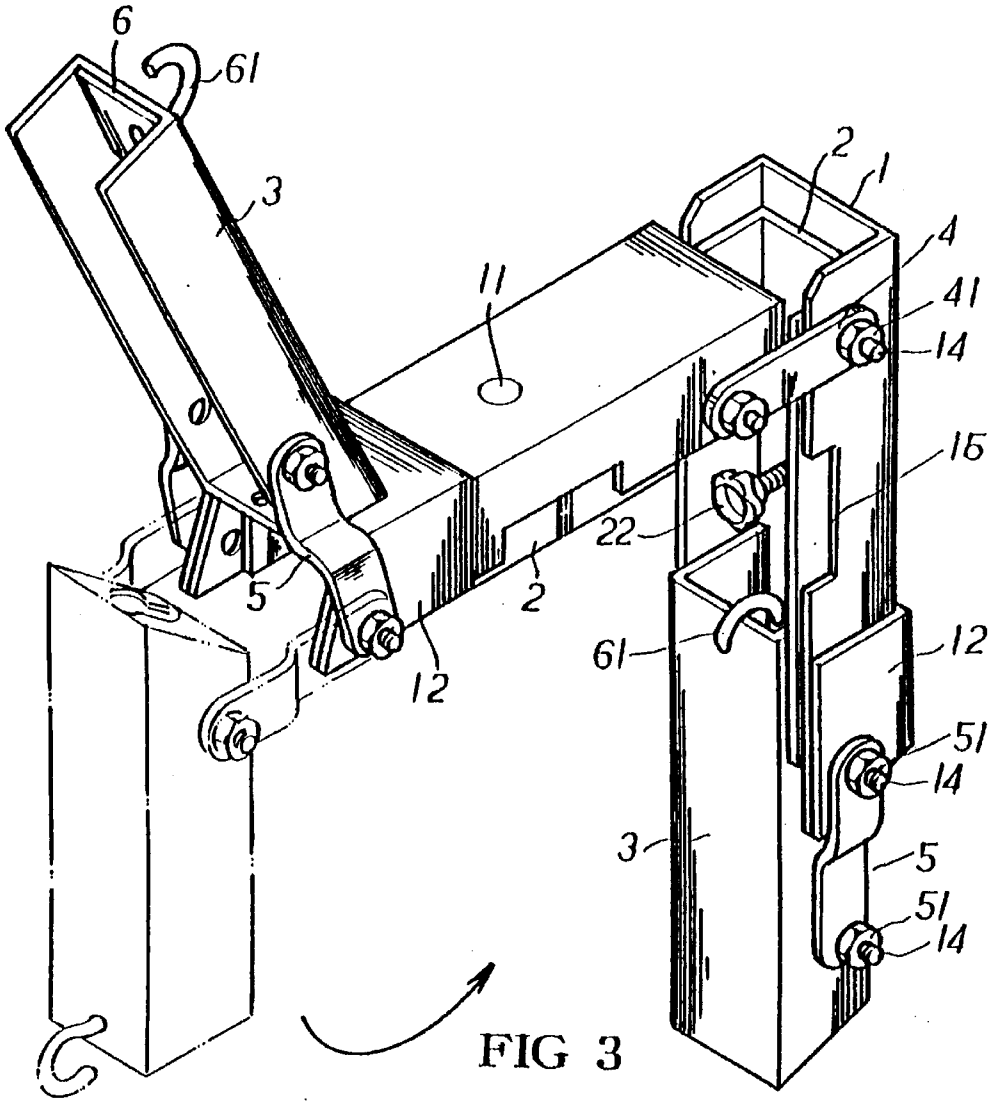
FIG. 3 is a perspective view illustrating the operation of the foldable hammock assembly.
Figure 4:
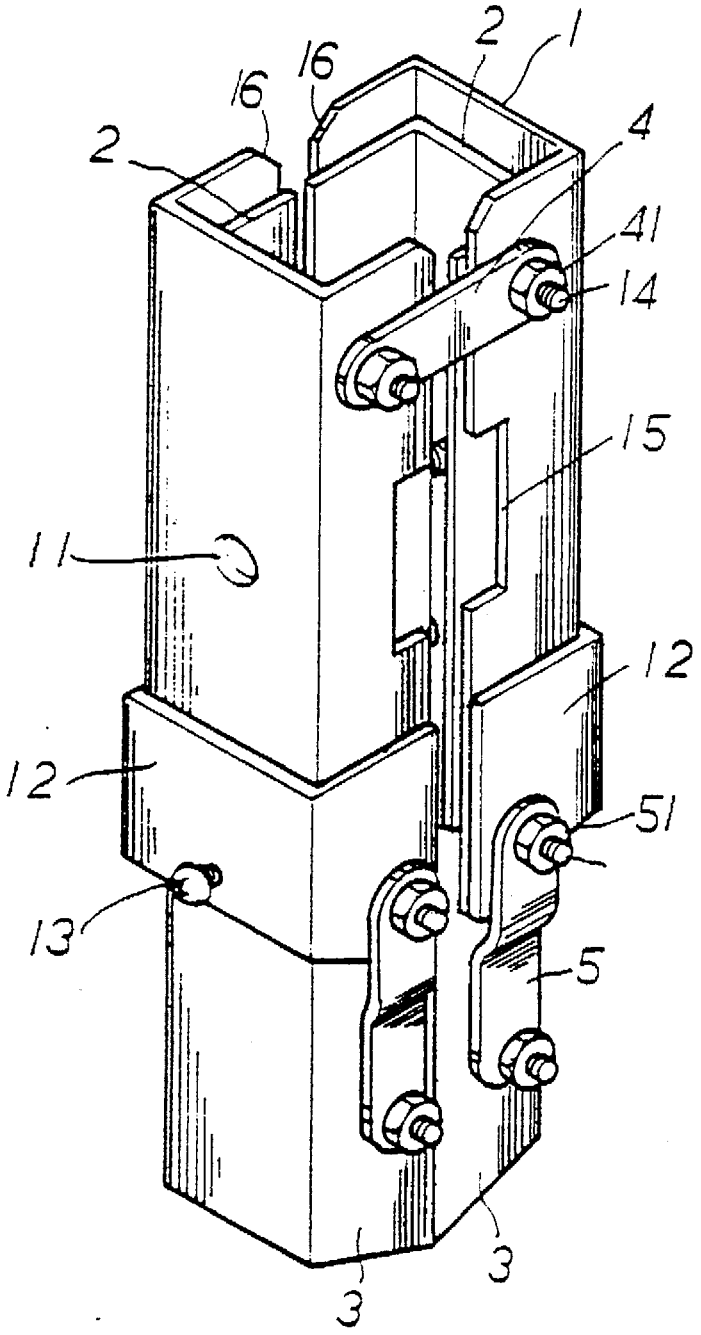
FIG. 4 is a perspective view illustrating the foldable hammock assembly in a folded configuration.

When not in operation, as shown in FIG. 3, the posts 3 may be folded relative to the beams 1 and may be engaged in the beams 1 when the screws 13 are disengaged from the key holes 31 and when the links 5 are released, such that the frame member may be folded to a rather compact configuration as shown in FIG. 4, which is excellent for storing and transportation purposes.

Accordingly, the foldable hammock assembly in accordance with the present invention includes a frame member for supporting the support sheet material such that the support sheet material is not required to be secured to trees.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A hammock stand, comprising:

a base having a first channel with a first width;

at least one support having a second channel with a second width less than the first width;

two posts with a third width less than the second width;

means for fastening opposite ends of a hammock to each of said posts;

first connecting means for releaseably connecting said at least one support to said base; and second connecting means for releasably connecting each of said two posts to said base, wherein, when the position of said two posts are altered and said at least one support is disconnected from said base, said two posts are positionable within said second channel and said at least one support is positionable within said first channel to compactly arrange the hammock stand for storage or transport.

2. A hammock stand as defined in claim 1, wherein:

said base includes two base portions and means for releaseably coupling said two base portions.

3. A hammock stand as defined in claim 2, wherein:

said at least one support includes a first support and a second support, and at least one of said base portions has a notched portion proportioned to engage either said first or said second support.

4. A hammock stand as defined in claim 1, wherein:

said at least one support is perpendicular to said base when connected by said first connecting means.

5. A hammock stand as defined in claim 1, wherein:

said first connecting means includes a bolt and nut fastener and a notch.

6. A hammock stand as defined in claim 1, wherein:

said second connecting means includes a bolt and keyhole fastener and a folding linkage.

7. A hammock stand as defined in claim 1, wherein:

said base includes two base portions and means for releaseably coupling said two base portions;

said at least one support is perpendicular to said base when connected by said first connecting means;

said first connecting means includes a bolt and nut fastener and a notch; and said second connecting means includes a bolt and keyhole fastener and a folding linkage.

8. A hammock stand, comprising:

a first base portion having a first channel with a first width;

a second base portion having a second channel with a second width equal to the first width;

a first support having a third channel with a third width less than the first width;

a second support having a fourth channel with a fourth width equal to the third width;

a first post having a fifth channel with a fifth width less than third width, said fifth channel having a first closed end;

a second post having a sixth channel with a sixth width equal to the fifth width, said sixth channel having a second closed end;

a first hook releasably secured to an end of said first post opposite to said first closed end;

a second hook releaseably secured to an end of said second post opposite to said second closed end;

a first connector releasably securing an end of said first base portion to an end of said second base portion such that said first channel and said second channel coincide;

a second connector releasably securing said first support to said first base portion;

a third connector releaseably securing said second support to said second base portion;

a fourth connector releaseably securing said first post to said first base portion;

a fifth connector releasably connecting said second post to said second base portion;

wherein, when the hammock stand is in a compacted state, said first post is positionable in said third channel of said first support which is positionable in said first channel of said first base portion and said second post is positionable in said forth channel of said second support which is positionable in said second channel of said second base portion, thereby providing a compact arrangement for storing and transporting the hammock stand.

9. A hammock support as defined in claim 8, wherein:

said first connector includes a folding linkage allowing said first base portion to fold against said second base portion such that said first channel and said second channel essentially abut to define a chamber, said first support, said second support, said first post and said second post being positionable within said chamber.

10. A hammock support as defined in claim 8, wherein:

said forth connector and said fifth connector each includes a folding linkage allowing said first post to fold into said third channel of said first support and said second post to fold into said fourth channel of said second support.

11. A hammock support as defined in claim 8, wherein:

said first connector includes a first folding linkage allowing said first base portion to fold against said second base portion such that said first channel and said second channel essentially abut to define a chamber, said first support, said second support, said first post and said second post being positionable within said chamber, said fourth connector includes a second folding linkage allowing said first post to fold into said third channel of said first support, and said fifth connector includes a third linkage allowing said second post to fold into said fourth channel of said second support.

12. A hammock support as defined in claim 11, wherein:

said first base portion includes a first notch for engaging said first supports, and said second base portion includes a second notch for engaging said second support.

* * * * *